US009038770B1

(12) United States Patent
Morrison

(10) Patent No.: US 9,038,770 B1
(45) Date of Patent: May 26, 2015

(54) FIREARM SUPPRESSOR

(71) Applicant: Robert Scott Morrison, Hoschton, GA (US)

(72) Inventor: Robert Scott Morrison, Hoschton, GA (US)

( * ) Notice: Subject to any disclaimer, the term of this patent is extended or adjusted under 35 U.S.C. 154(b) by 0 days.

(21) Appl. No.: 14/134,023

(22) Filed: Dec. 19, 2013

Related U.S. Application Data

(60) Provisional application No. 61/836,508, filed on Jun. 18, 2013, provisional application No. 61/872,012, filed on Aug. 30, 2013, provisional application No. 61/892,070, filed on Oct. 17, 2013, provisional application No. 61/892,087, filed on Oct. 17, 2013.

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 1,017,003 | A | | 2/1912 | Kenney |
| 1,482,805 | A | | 2/1924 | Maxim |
| 3,385,164 | A | | 5/1968 | Karl-Heinz Walther et al. |
| 4,291,610 | A | | 9/1981 | Waiser |
| 4,530,417 | A | | 7/1985 | Daniel |
| 4,576,083 | A | | 3/1986 | Seberger, Jr. |
| 4,584,924 | A | * | 4/1986 | Taguchi ..... 89/14.4 |
| 4,588,043 | A | | 5/1986 | Finn |
| 4,869,151 | A | | 9/1989 | Chahin |
| 4,907,488 | A | | 3/1990 | Seberger, Jr. |
| 4,974,489 | A | | 12/1990 | Fishbaugh |
| 5,029,512 | A | | 7/1991 | Latka |
| 5,092,223 | A | | 3/1992 | Hudson |
| 5,136,923 | A | | 8/1992 | Walsh, Jr. |
| 5,164,535 | A | | 11/1992 | Leasure |
| 5,425,299 | A | | 6/1995 | Teetzel |
| 5,476,028 | A | | 12/1995 | Seberger, Jr. |
| 5,610,360 | A | | 3/1997 | Kazyaka et al. |
| 5,773,746 | A | | 6/1998 | Vaden |
| D415,812 | S | | 10/1999 | Andrews, Jr. et al. |
| D415,813 | S | | 10/1999 | O'Quinn et al. |
| D435,623 | S | | 12/2000 | Andrews, Jr. et al. |
| 6,302,009 | B1 | | 10/2001 | O'Quinn et al. |
| 6,308,609 | B1 | | 10/2001 | Davies |
| 6,374,718 | B1 | | 4/2002 | Rescigno et al. |
| 6,575,074 | B1 | | 6/2003 | Gaddini |
| 7,073,426 | B1 | | 7/2006 | White |
| 7,194,836 | B1 | | 3/2007 | Urban |
| 7,325,474 | B2 | | 2/2008 | Yoshimura et al. |
| D594,082 | S | | 6/2009 | O'Quinn |

(Continued)

OTHER PUBLICATIONS

U.S. Office Action mailed on Oct. 28, 2014 in U.S. Appl. No. 14/134,044.

*Primary Examiner* — Forrest M Phillips
(74) *Attorney, Agent, or Firm* — Hartman & Citrin LLC

(57) ABSTRACT

Embodiments of a firearm suppressor are disclosed herein. According to various embodiments, the firearm suppressor can include a housing. The housing can include an outer surface, an inner cavity, and an attachment mechanism that attaches the housing to a barrel of a firearm. The inner cavity can accommodate a baffle. The firearm suppressor also can include a lighting attachment. The lighting attachment can include a power source and a lighting mechanism.

20 Claims, 6 Drawing Sheets

(56) References Cited

U.S. PATENT DOCUMENTS

| | | | | |
|---|---|---|---|---|
| 7,854,085 | B1 | 12/2010 | Hodgkins et al. | |
| 7,905,171 | B1 | 3/2011 | Brittingham | |
| 8,096,222 | B2 | 1/2012 | Silvers | |
| 8,162,100 | B2 * | 4/2012 | Shults et al. | 181/223 |
| 8,167,084 | B1 | 5/2012 | Moore | |
| 8,439,155 | B2 * | 5/2013 | Shults et al. | 181/223 |
| 8,479,632 | B2 * | 7/2013 | Kline et al. | 89/14.4 |
| 8,479,878 | B2 | 7/2013 | Schlosser | |
| 2007/0107590 | A1 * | 5/2007 | Silvers | 89/14.4 |
| 2010/0126334 | A1 * | 5/2010 | Shults et al. | 89/14.4 |
| 2011/0067950 | A1 * | 3/2011 | Shults et al. | 181/223 |

* cited by examiner

FIREARM SUPPRESSOR

CROSS-REFERENCE TO RELATED APPLICATIONS

This application claims priority to U.S. Provisional Patent Application No. 61/836,508, filed Jun. 18, 2013, entitled "Improved Suppressor," which is incorporated herein by reference in its entirety. This application also claims priority to U.S. Provisional Patent Application No. 61/872,012, filed Aug. 30, 2013, entitled "Light Enhanced Firearm Suppressor," which is incorporated herein by reference in its entirety. This application also claims priority to U.S. Provisional Patent Application No. 61/892,070, filed Oct. 17, 2013, entitled "Superior Signature Suppressor," which is incorporated herein by reference in its entirety. This application also claims priority to U.S. Provisional Patent Application No. 61/892,087, filed Oct. 17, 2013, entitled "Improved Surface Treatment Suppressor," which is incorporated herein by reference in its entirety.

TECHNICAL FIELD

This disclosure relates generally to firearm technologies. More particularly, the disclosure made herein relates to an extremely effective firearm suppressor that can be economically manufactured.

BACKGROUND

Unless otherwise indicated herein, the materials described in this section are not prior art to the claims in this application and are not admitted to be prior art by inclusion in this section.

Firearm suppressors are sometimes referred to as "silencers." The term "silencer," however, while being partially accurate, does not explain or identify the various functions of a well-manufactured and well-used suppressor. In particular, a suppressor functions to not only suppress an audible signature of a firearm, but also to suppress the muzzle flash and other visible signatures of firearms. As such, suppressors can be used to allow firearm use without personal hearing protection. In military applications, suppressors can reduce detectability, as well as allowing soldiers or other entities to discharge firearms without compromising their ability to hear other sounds in their environment.

Because suppressors can allow shooters to discharge firearms without personal hearing protection, and to reduce the muzzle flash and other visible effects of firearm discharge, suppressors have become popular accessories with shooters. In fact, some shooters wish to acquire a suppressor for each owned firearm after firing a suppressed firearm due to the reduced sound and flash of a firearm discharge. In general, suppressors can make shooting more enjoyable.

The benefits of suppressors, however, are not limited to comfort and enjoyment. Suppressors also can be used for personal defense, military applications, hunting, and the like. In particular, because adrenaline-inducing events can result in visual distortion such as tunnel vision, depth perception issues, and the like, some firearm owners equip personal defense firearms with suppressors to reduce the likelihood of such issues in a violent encounter. For military applications, suppressors can aid soldiers in stealthily attacking targets with firearms by reducing the detectability of the firearms visually and audibly.

For these and other reasons, suppressors have become popular accessories for firearm owners and users. Suppressors, however, are expensive to make and therefore are expensive to own. Additionally, the regulatory framework around suppressor manufacturing and ownership combine with the high cost of manufacturing to result in limited suppressor ownership and availability.

SUMMARY

Concepts and technologies are disclosed herein for a firearm suppressor. In some embodiments, a firearm suppressor can include a housing and a baffle insert assembly. In some embodiments, the baffle insert assembly can be formed from a single piece of material such as, for example, a baffle insert blank that can be formed from sheet metal or other material. Of course, some embodiments of the firearm suppressor include a baffle insert assembly that can be formed from more than one piece of material and/or can include stacked baffle insert assemblies that may be, or may not be, connected together. In some embodiments, one or more pieces of material can be formed from sheet metal, which can be machined or otherwise processed to obtain one or more baffle insert blank. The baffle insert blank can be bent via various processes to obtain a baffle insert assembly that includes a number of baffles.

The baffle insert assembly can be inserted into a firearm suppressor housing to form a firearm suppressor. The firearm suppressor can be durable, economical, and effective, among other qualities. In particular, the baffle insert assembly can be configured to contact sidewalls of the firearm suppressor housing to provide strength for the firearm suppressor. Because the baffle insert assembly can be formed from sheet metal, the materials used to form the baffle insert assembly, and the processes used to form the baffle insert assembly can be low cost. Furthermore, because the baffles can be formed from sheet metal, the surface area to volume ratio of the baffles can be high, resulting in effective, yet light weight, suppression capabilities. These and other aspects of the concepts and technologies described herein will be described herein in further detail.

According to one aspect of the concepts and technologies described herein, a firearm suppressor is disclosed. The firearm suppressor can include a firearm suppressor housing including an outer surface, an inner cavity that accommodates a baffle insert assembly, and an attachment mechanism that can attach the firearm suppressor housing to a barrel of a firearm. The firearm suppressor also can include the baffle insert assembly. The baffle insert assembly can include a number of baffles, which in some embodiments can be formed from a single piece of material.

In some embodiments, the baffle insert assembly can be inserted into the firearm suppressor housing. The firearm suppressor housing can include sidewalls, and the baffle insert assembly can be configured to contact the sidewalls to align the number of baffles within the firearm suppressor housing. In some embodiments, the baffle insert assembly can be formed from a baffle insert blank. In some embodiments, the baffle insert blank can be formed from a single piece of sheet metal.

In some embodiments, the baffle insert assembly can include a first baffle that can be angularly offset from a second baffle by a first angle. The first baffle also can be angularly offset from a third baffle by a second angle. In some embodiments, the baffle insert assembly can be formed from a material selected from a list of materials. The list of materials can include, for example, titanium, aluminum, brass, and steel. In some embodiments, the firearm suppressor can include ten or more baffles.

According to another aspect of the concepts and technologies described herein, a firearm suppressor is disclosed. The firearm suppressor can include a firearm suppressor housing that can include a sidewall having an outer surface, an inner cavity that accommodates a baffle insert assembly, and an attachment mechanism that can be configured to attach the firearm suppressor housing at a location proximate to a barrel of a firearm. The firearm suppressor also can include the baffle insert assembly, which can be configured for insertion into the inner cavity. The baffle insert assembly can include a number of baffles. In some embodiments, the baffle insert assembly can be formed from a single piece of material.

In some embodiments, the baffle insert assembly can be inserted into the firearm suppressor housing, and the baffle insert assembly can be configured to contact the sidewalls to align the number of baffles within the firearm suppressor housing. The baffle insert assembly can be formed from a baffle insert blank, which in some embodiments can be formed from a single piece of material. In some embodiments, the single piece of material can include a piece of sheet metal. In some embodiments, the baffle insert assembly can include a first baffle that can be angularly offset from a second baffle by a first angle. The first baffle also can be angularly offset from a third baffle by a second angle.

In some embodiments, the first angle can be equivalent to the second angle. In some embodiments, the first angle can be different from the second angle. In some embodiments, the baffle insert assembly can be formed from a first material selected from a list of materials. The list of materials can include, for example, titanium, aluminum, brass, and steel. In some embodiments, a portion of the firearm suppressor housing can be formed from a second material selected from the list, which can include titanium, aluminum, brass, and steel.

According to yet another aspect of the concepts and technologies described herein, a baffle insert assembly is disclosed. The baffle insert assembly can be configured for insertion into a firearm suppressor housing including an inner cavity and an attachment mechanism that can be configured to attach the firearm suppressor housing at a location proximate to a barrel of a firearm. The baffle insert assembly can include a number of baffles, which in some embodiments can be formed from a single piece of material. The number of baffles can include a first baffle arranged at a first angle, a second baffle arranged at a second angle, and a third baffle arranged at a third angle. The first baffle, the second baffle, and the third baffle can be connected as part of the single piece of material.

In some embodiments, the baffle insert assembly can be configured to contact the sidewalls of the firearm suppressor housing to align the number of baffles within the firearm suppressor housing. In some embodiments, the baffle insert assembly can be formed from a baffle insert blank. In some embodiments, the baffle insert blank can be formed from a single piece of sheet metal. The number of baffles can include a first baffle angularly offset from a second baffle by a first angle. The first baffle also can be angularly offset from a third baffle by a second angle.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
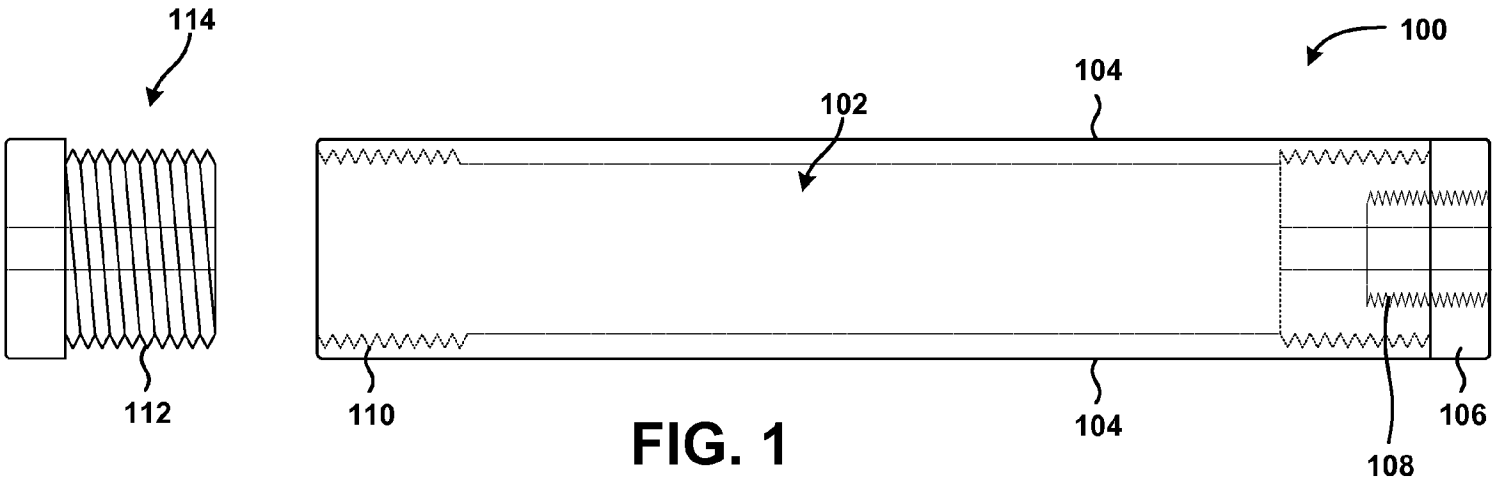
FIG. 1 is a line drawing illustrating an assembly view of a firearm suppressor housing, according to an illustrative embodiment of the concepts and technologies described herein.

The following detailed description is directed to a firearm suppressor. In some embodiments, a firearm suppressor can include a housing and a baffle insert assembly that can be inserted into the housing to form a firearm suppressor. In some embodiments, a firearm suppressor can include a housing and a baffle insert assembly. The baffle insert assembly can be formed from a single piece of material or from multiple pieces of material, according to various embodiments of the concepts and technologies described herein. In some embodiments, the baffle insert assembly can be formed from a single piece of material, which can include a baffle insert blank that can be formed from sheet metal or other material. In some embodiments, the sheet metal can be machined or otherwise processed to obtain a baffle insert blank. The baffle insert blank can be bent via various processes to obtain a baffle insert assembly that includes a number of baffles. In various embodiments, the baffle insert assembly can include a single piece of material that includes a number of baffles. This can allow easy cleaning and/or disassembly of the firearm suppressor, in some embodiments.

The baffle insert assembly can be inserted into a firearm suppressor housing to form a firearm suppressor. The firearm suppressor can be durable, economical, effective, and lightweight, among other qualities. In particular, the baffle insert assembly can be configured to provide strength for the firearm suppressor. Because the baffle insert assembly can be formed from sheet metal, the materials used to form the baffle insert assembly, and the processes used to form the baffle insert assembly can be economical to produce, ship, and/or process. Furthermore, because the baffles can be formed from sheet metal, the baffles can have a large amount of surface area relative to total volume when compared to other types of firearm suppressors such as stacked cone designs, or the like. Thus, the firearm suppressor can provide exceptional performance, while maintaining a low weight relative to other types of suppressors. These and other aspects of the concepts and technologies described herein will be described herein in further detail.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of firearm suppressors will be presented.

Turning to FIG. 1, aspects of a firearm suppressor according to various embodiments of the concepts and technologies described herein will be described in detail. In particular, FIG. 1 illustrates one illustrative embodiment of a firearm suppressor housing 100. Because the concepts and technologies described herein for providing a firearm suppressor can be embodied in various implementations of suppressors, it should be understood that the illustrated and described illustrative embodiment is merely one example of a suitable operating environment for the concepts and technologies described herein for providing a firearm suppressor. As such, the illustrated and described embodiments should not be construed as being limiting in any way of the concepts and technologies described herein.

In some embodiments, as shown in FIG. 1, a firearm suppressor can include a firearm suppressor housing 100. The firearm suppressor housing 100 can be formed from an assembly of two or more components. In some embodiments, the firearm suppressor housing 100 may be formed from a substantially continuous piece of material such as a metal rod or metal tube that can be machined by various processes and/or tools. According to various embodiments, including the embodiment shown in FIG. 1, the firearm suppressor housing 100 can be formed as a cylindrical structure. The firearm suppressor housing 100 can include an inner cavity 102, which can be defined by an outer surface 104.

It can be appreciated that the firearm suppressor housing 100 can be configured to house a baffle, a baffle insert, and/or other structures and/or elements such as the baffle insert assembly described herein, though this is not necessarily the case. Various embodiments of baffle insert assemblies, baffles, baffle inserts, and/or other structures or elements that can be located within the inner cavity 102 are illustrated and described in co-pending U.S. Provisional Patent Application No. 61/836,508, filed Jun. 18, 2013, entitled "Improved Suppressor," which is incorporated herein by reference in its entirety. Because other baffles, baffle inserts, baffle insert assemblies, and/or other structures and/or elements are possible and are contemplated, it should be understood that these examples are illustrative and therefore should not be construed as being limiting in any way.

The firearm suppressor housing 100 also can include and/or can engage a leading edge cap 106. The leading edge cap 106 can include and/or can be configured to engage barrel threads 108 or other structures. According to various embodiments of the concepts and technologies described herein, the barrel threads 108 are configured to engage threads or other structures of a barrel of a firearm (not shown in FIG. 1). Thus, the barrel threads 108 can be used to hold the firearm suppressor 400 in an operating configuration with respect to a firearm, as generally is understood by one familiar with the operation of firearm suppressors. Because the leading edge cap 106 and the barrel threads 108 are generally understood structural elements of firearm suppressors such as the firearm suppressor 400, these elements are not further described herein.

The firearm suppressor housing 100 and/or the components of the firearm suppressor housing 100 may be formed by various processes and/or materials. According to various embodiments of the concepts and technologies described herein, the firearm suppressor housing 100, or a portion thereof, can be formed from metals and/or alloys, resins, polymers, and/or other materials. In some embodiments, for example, the firearm suppressor housing 100 and/or a portion thereof can be formed from a metal and/or alloy such as steel, aluminum, titanium, brass, copper, magnesium alloys, aluminum alloys, other metals or alloys, combinations thereof, or the like. In some embodiments, for example, the firearm suppressor housing 100, or a portion thereof, can be formed from resins such as epoxy resins, or the like. In some embodiments, for example, the firearm suppressor housing 100, or a portion thereof, can be formed from one or more polymers such as various thermoplastics, polypropylene, polycarbonates, graphite filled NYLON, phenolics, polyimides, and/or other polymers, combinations thereof, or the like.

The firearm suppressor housing 100 can be formed using various processes such as, for example, extrusion, machining, injection molding, casting, combinations thereof, or the like. In one contemplated embodiment, the firearm suppressor housing 100 is formed from an extruded or formed metal tube (e.g., an extruded aluminum tube) that can be machined to obtain the various structures visible in FIG. 1 as well as additional or alternative structures. In another contemplated embodiment, the firearm suppressor housing 100, or a portion thereof, can be formed from a metal rod (e.g., an extruded or formed aluminum or steel rod or pipe) that can be machined using various tools and/or processes to obtain the firearm suppressor housing 100. Because various manufacturing processes can be used and/or selected based upon various needs (cost, materials, time, etc.), it should be understood that these examples are illustrative and therefore should not be construed as being limiting in any way.

The outer surface 104 of the firearm suppressor housing 100 and/or the entire firearm suppressor housing 100 can be treated for various purposes. In some embodiments, for example, the outer surface 104 of the firearm suppressor housing 100, or the entire firearm suppressor housing 100, can be treated with coatings, paints, chemical processes, or the like. For example, in some embodiments the outer surface 104 of the firearm suppressor housing 100 can be treated with one or more processes commonly referred to as "gun bluing." For example, the outer surface 104 of the firearm suppressor housing 100, or the entire firearm suppressor housing 100, can be treated using an electrochemical conversion coating process such as fume bluing, cold bluing, hot bluing, niter bluing, rust bluing, browning, or the like. The outer surface 104 of the firearm suppressor housing 100, or the entire firearm suppressor housing 100, also can be polished, sandblasted, or otherwise treated to provide a shiny, satin, or unfinished surface appearance. The outer surface 104 of the firearm suppressor housing 100, or the entire firearm suppressor housing 100, can be given an anodized coating treatment, if desired. Because other processes and/or coatings are contemplated and are possible, it should be understood that these examples are illustrative and therefore should not be construed as being limiting in any way.

The firearm suppressor housing 100 also can be treated with other processes to, for example, enhance strength, add corrosion resistance, for aesthetic purposes, combinations thereof, or the like. In some embodiments, the firearm suppressor housing 100 is formed from titanium and is coated or laminated with films, coatings, or the like. In another contemplated embodiment, the firearm suppressor housing 100 can be formed from titanium and treated with a heat anodization process. Because additional and/or alternative treatment processes are possible and are contemplated, it should be understood that these examples are illustrative and therefore should not be construed as being limiting in any way.

The firearm suppressor housing 100 also can include trailing edge cap attachment threads 110. The trailing edge cap attachment threads 110 can be configured to engage to engage reciprocal housing attachment threads 112 of a trailing edge cap 114 or other attachment such as a lighting attachment, or the like. The trailing edge cap attachment threads 110 can be replaced and/or supplemented with other attachment mechanisms, if desired, such as rivets, bolts, compression fittings, pins, combinations thereof, or the like Because the trailing edge cap attachment threads 110 can be replaced and/or supplemented with additional and/or alternative attachment mechanisms, it should be understood that the housing attachment threads 112 of the trailing edge cap 114 can be replaced and/or supplemented with additional and/or alternative connection mechanisms and/or reciprocal connection mechanisms.

Figure 2:
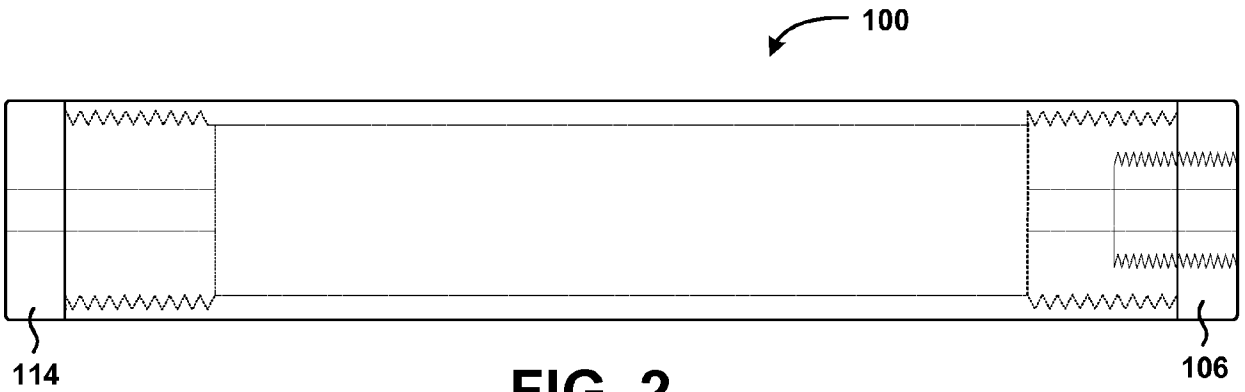
FIG. 2 is a line drawing illustrating the firearm suppressor housing shown in FIG. 1, according to another illustrative embodiment of the concepts and technologies described herein.

According to various embodiments, as shown with collective reference to FIGS. 1 and 2, the trailing edge cap 114 can be connected to the firearm suppressor housing 100 by mating connection mechanisms on the firearm suppressor housing 100 and the trailing edge cap 114, for example the trailing edge cap attachment threads 110 and the housing attachment threads 112, respectively. Although not visible in FIGS. 1-2, it should be understood that other structures can be located between the firearm suppressor housing 100 and the trailing edge cap 114, for example a plastic or silicone washer, padding, combinations thereof, or the like. Furthermore, as will be more clearly understood with reference to FIGS. 3-7E below, a baffle, baffle insert, and/or baffle insert assembly can be located within the firearm suppressor housing to obtain a firearm suppressor. These and other aspects of the concepts and technologies described herein will be further illustrated and described below.

Figure 3:
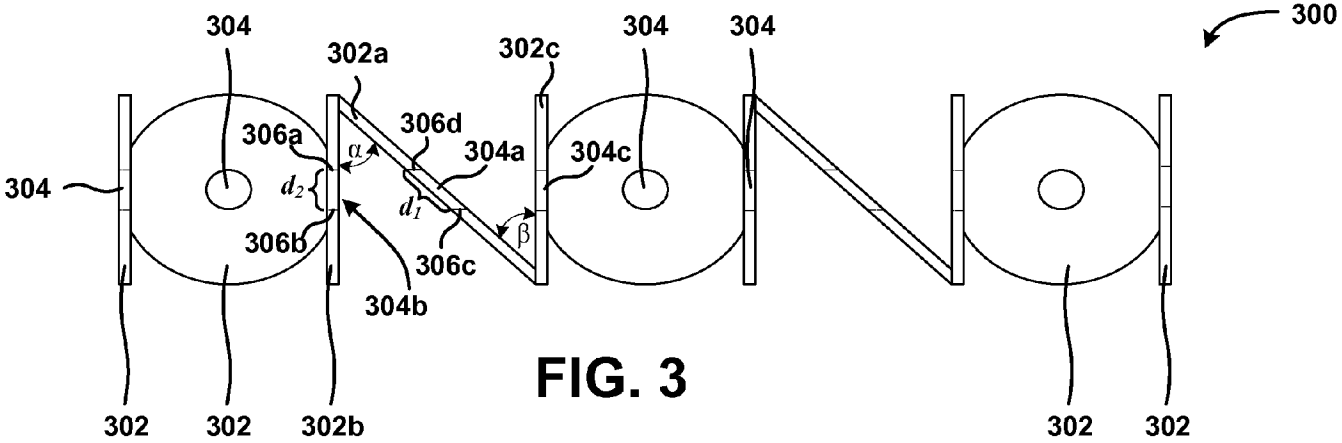
FIG. 3 is a line drawing illustrating a side view of a baffle insert assembly for a firearm suppressor, according to one illustrative embodiment of the concepts and technologies described herein.

Turning now to FIG. 3, additional aspects of the concepts and technologies described herein for firearm suppressors will be described in detail. In particular, FIG. 3 illustrates a side, top, or bottom view of a baffle insert assembly 300 for a firearm suppressor, according to one illustrative embodiment of the concepts and technologies described herein. As will be more clearly understood with reference to the description of FIGS. 3-7E below, the various dimensions, arrangement, and/or configuration of the various components of the baffle insert assembly 300 can be varied for particular applications and/or needs. As such, it should be understood that the embodiment shown in FIG. 3 is illustrative and therefore should not be construed as being limiting in any way.

As can be seen in FIG. 3, the baffle insert assembly 300 can include a number of baffle surfaces ("baffles") 302. The baffles 302 can be arranged at various angles with respect to one another. As such, the illustrated configuration should be understood as being merely illustrative of one contemplated embodiment that is provided to explain various aspects of the concepts and technologies described herein. As such, the illustrated embodiment should not be construed as being limiting in any way.

In some embodiments, the baffle insert assembly 300 can be formed from a single piece of material. Of course, it should be understood that the baffle insert assembly 300 can be formed from multiple pieces of material and/or that multiple baffle insert assemblies 300 can replace a single baffle insert assembly 300, if desired. Thus, for example, two or more baffle insert assemblies 300 can be stacked or connected together to provide functionality that may be different, similar, or even identical to a single baffle insert assembly 300 as disclosed herein. As such, the embodiment of a baffle insert assembly 300 that is formed from a single piece of material should be understood as being only one contemplated embodiment of the concepts and technologies described herein and therefore should not be construed as being limiting in any way.

In some embodiments, the baffle insert assembly 300 can be formed from a baffle insert blank, as will be illustrated and described below with reference to FIG. 6. In some embodiments, the baffles 302 can be offset by one or more angles. For example, as shown in FIG. 3, a particular baffle 302*a* may be offset by a first neighboring baffle 302*b* by an angle $\alpha$, while the same baffle 302*a* may be offset by a second neighboring baffle 302*c* by an angle $\beta$. The angle $\alpha$ and the angle $\beta$ can be equal to one another or different from one another. Thus, the illustrated embodiment, wherein the baffles 302 appear to be offset by substantially equivalent angles should be understood as being illustrative and should not be construed as being limiting in any way.

The baffles 302 also can include an aperture or bore ("aperture") 304 through which a bullet or other projectile(s) pass after being fired by a firearm. Of course, the aperture 304 can accommodate other structures such as sighting instruments, cleaning rods and/or tools, lights or lighting devices, combinations thereof, or the like. As will be more clearly understood with reference to FIG. 6, the sizes of the baffles 302 and the apertures 304 can vary with respect to one another based, at least partially, upon the angles used as offsets of the various baffles and/or the configuration of the baffle insert assembly 300. For example, the aperture 304*a* that is formed in the baffle 302*a* can have a diameter $d_1$ that can be greater than a diameter $d_2$ of the apertures 304*b*, 304*c* formed in the baffles 302*b*, 302*c*, though this is not necessarily the case.

Furthermore, as can be seen in FIG. 3, the side walls 306*a*, 306*b* are illustrated in FIG. 3 as being angled along a line that is parallel to the sidewalls 306*c*, 306*d* of the apertures 304*b*, 304*c* formed in the baffles 302*b*, 302*c*, though this is not necessarily the case. In particular, in some embodiments of the concepts and technologies described herein, the apertures 304 can be formed in the baffles 302 prior to bending of the blank using a stamping, machining, or other desired process. As such, the sidewalls 306*a*, 306*b* may not be angled as shown with respect to the baffle 302*a*. Instead, the sidewalls 306*a*, 306*b* and the diameter $d_1$ can be configured and/or chosen, respectively, such that the projectile fired through the baffle insert assembly 300 will not contact the sidewalls 306 of any of the baffles 302, regardless of the configuration of the baffles 302. Therefore, it should be understood that this example is illustrative and therefore should not be construed as being limiting in any way.

As mentioned above, and as will be more clearly understood with reference to FIGS. 6-8 below, the baffle insert assembly 300 can be formed from a single piece of material such as, for example, a baffle insert blank. A piece of material such as sheet metal or other material can be obtained and processed (e.g., via stamping, machining, combinations thereof, or the like), to obtain the baffle insert blank. The baffle insert blank can be bent via various bending processes to obtain the baffle insert assembly 300. The baffle insert assembly 300 can be inserted into the firearm suppressor housing 100 to obtain a firearm suppressor 400, as shown in FIG. 4.

Figure 4:
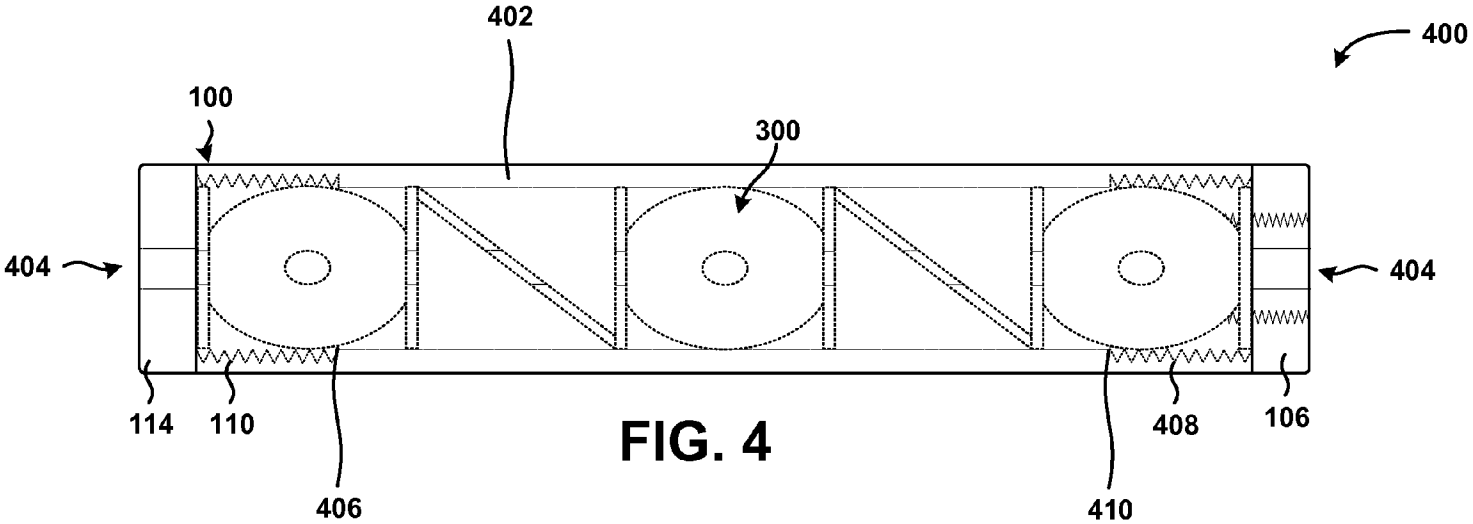
FIG. 4 is a line drawing illustrating an assembled firearm suppressor obtained by inserting the baffle insert assembly illustrated in FIG. 3 into the firearm suppressor housing illustrated in FIGS. 1-2, according to one illustrative embodiment of the concepts and technologies described herein.

As can be appreciated with reference to FIG. 4, the baffles 302 of the baffle insert assembly 300 can be contained within and/or aligned by the sidewalls 402 of the firearm suppressor housing 100. Similarly, the apertures 304 of the baffles 302 of the baffle insert assembly 300 can be aligned, by alignment of the baffles 302 by the sidewalls 402 of the firearm suppressor housing 100, with the apertures 404 formed in the trailing edge cap 114 and the leading edge cap 106 of the firearm suppressor housing 100. Through alignment of the apertures 304 and the apertures 404, a path through the firearm suppressor 400 for a projectile fired from a firearm can be formed.

As generally is understood, firearm suppressors such as the firearm suppressor 400 can function by shearing hot expanding gasses resulting from firing a firearm. In particular, as the gases expand out of the muzzle of the firearm barrel and into the firearm suppressor 400, the baffles 302 of the baffle insert assembly 300 can shear the gases, giving the gases time to cool and dissipate, which in turn can reduce the audible and visible signature of a firearm firing. Similarly, the pressure discharge that typically results from firing a firearm can be reduced by the use of the firearm suppressor 400, which can further reduce audible signatures of firearm discharges.

Depending upon the caliber of firearm for which the firearm suppressor 400 is intended, the angles, curves, configurations, diameters, offset angles, and/or other aspects of the baffles 302 and/or other features of the baffle insert assembly 300 may be modified or altered to alter the suppressive effect of the firearm suppressor 400. At times, the considerations of suppressive effect must be balanced against the impact on projectile performance (e.g., by slowing the speed of the projectile), and as such, the arrangement and/or configuration of the baffles 302 of the baffle insert assembly 300 may be tailored for various purposes.

It should be understood that various features of the firearm suppressor 400 are not shown to scale for purposes of more clearly illustrating the concepts and technologies described herein. In particular, it should be understood that the trailing edge cap attachment threads 110 can terminate at any desired point within the firearm suppressor housing 100 and need not extend to the point 406 shown in FIG. 4. The length of the trailing edge cap attachment threads 110 can be based upon the length of the housing attachment threads 112 and/or other considerations, if desired.

Similarly, it should be understood that the firearm suppressor housing 100 can include leading edge cap threads 408 for engaging threads formed on the leading edge cap 106, if desired. The leading edge cap threads 408 can terminate at any desired point within the firearm suppressor housing 100 and need not extend to the point 410 shown in FIG. 4. The length of the leading edge cap threads 408 can be based upon the length of leading edge cap threads formed on the leading edge cap 106 (not visible in FIG. 4), which can be substantially similar, in some embodiments, to the housing attachment threads 112 of the trailing edge cap 114. It should be understood that this example is illustrative and therefore should not be construed as being limiting in any way.

Similarly, the length of the baffle insert assembly 300 can be adjusted to extend along any desired length of the firearm suppressor housing 100. For example, the baffle insert assembly 300 can be configured to extend from the trailing edge cap 114 to the leading edge cap 106, from the point 406 to the point 410, and/or along other lengths and/or dimensions of the firearm suppressor housing 100. It should be understood that these examples are illustrative and therefore should not be construed as being limiting in any way.

Figure 5A:
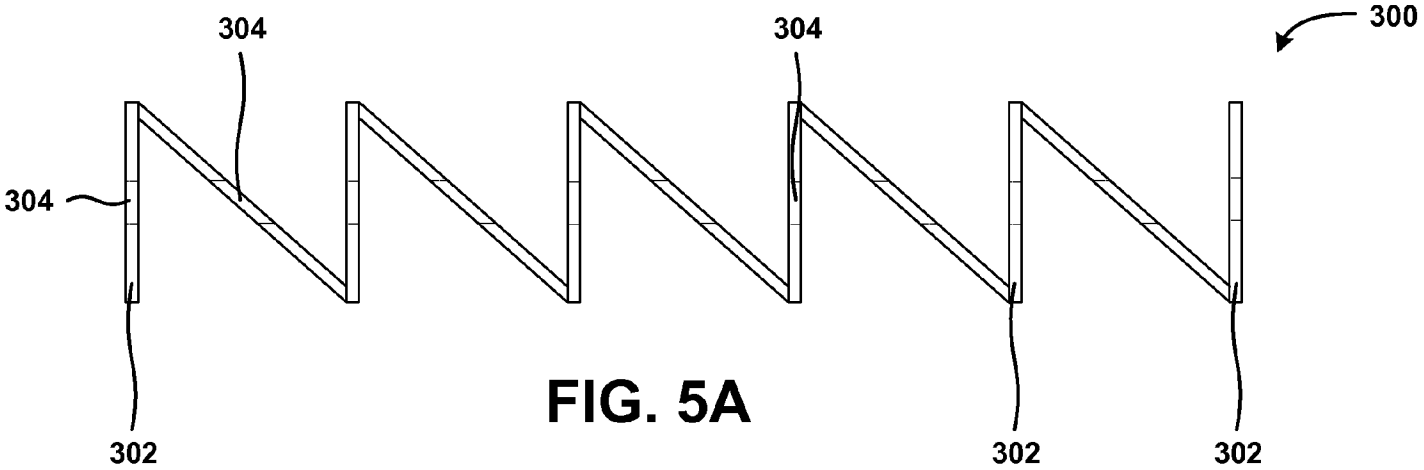
FIGS. 5A-5B are line drawings illustrating two views of a baffle insert assembly, according to another illustrative embodiment of the concepts and technologies described herein.
Figure 5B:
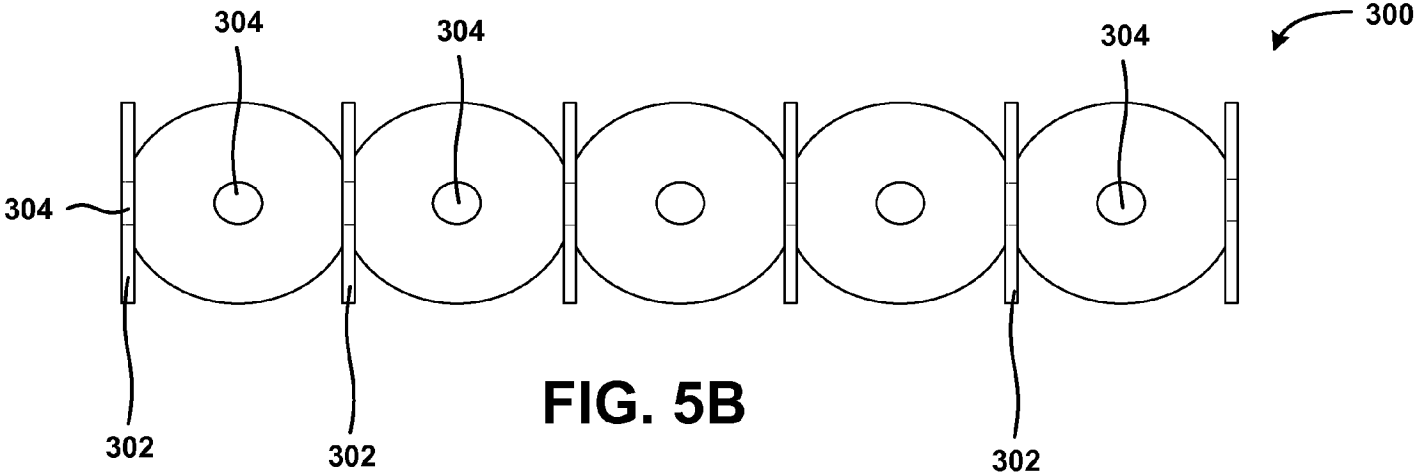

Turning now to FIGS. 5A-5B, additional aspects of the concepts and technologies described herein for firearm suppressors 400 will be described in detail. In particular, FIG. 5A is a line drawing illustrating a side view of a baffle insert assembly 300, and FIG. 5B is a line drawing illustrating a top or bottom view of the baffle insert assembly 300 illustrated in FIG. 5A. Because the "side" and/or "top or bottom" of the baffle insert assembly 300 are purely relative terms (there truly is no side, bottom, top, or the like), it should be understood that the views illustrated in FIGS. 5A and 5B can correspond to views that would be obtained by rotating the baffle insert assembly 300 ninety degrees about an axis a that passes through the apertures 304 of the baffles 302. As such, it should be understood that the illustrated views are illustrative and therefore should not be construed as being limiting in any way.

With reference to FIG. 5A, it can be appreciated that the baffle insert assembly 300 can be similar to the baffle insert assembly 300 shown in FIG. 3, but that the baffles 302 of the embodiment of the baffle insert assembly 300 shown in FIGS. 5A-5B are arranged differently relative to the baffles 302 of the embodiment of the baffle insert assembly 300 shown in FIG. 3. Thus, the illustrated embodiment of the baffle insert assembly 300 shown in FIGS. 5A-5B is provided to show that the configuration and/or arrangement of the baffles 302 of the baffle insert assembly 300 can be varied. It should be understood that this example is illustrative and therefore should not be construed as being limiting in any way.

Figure 6:
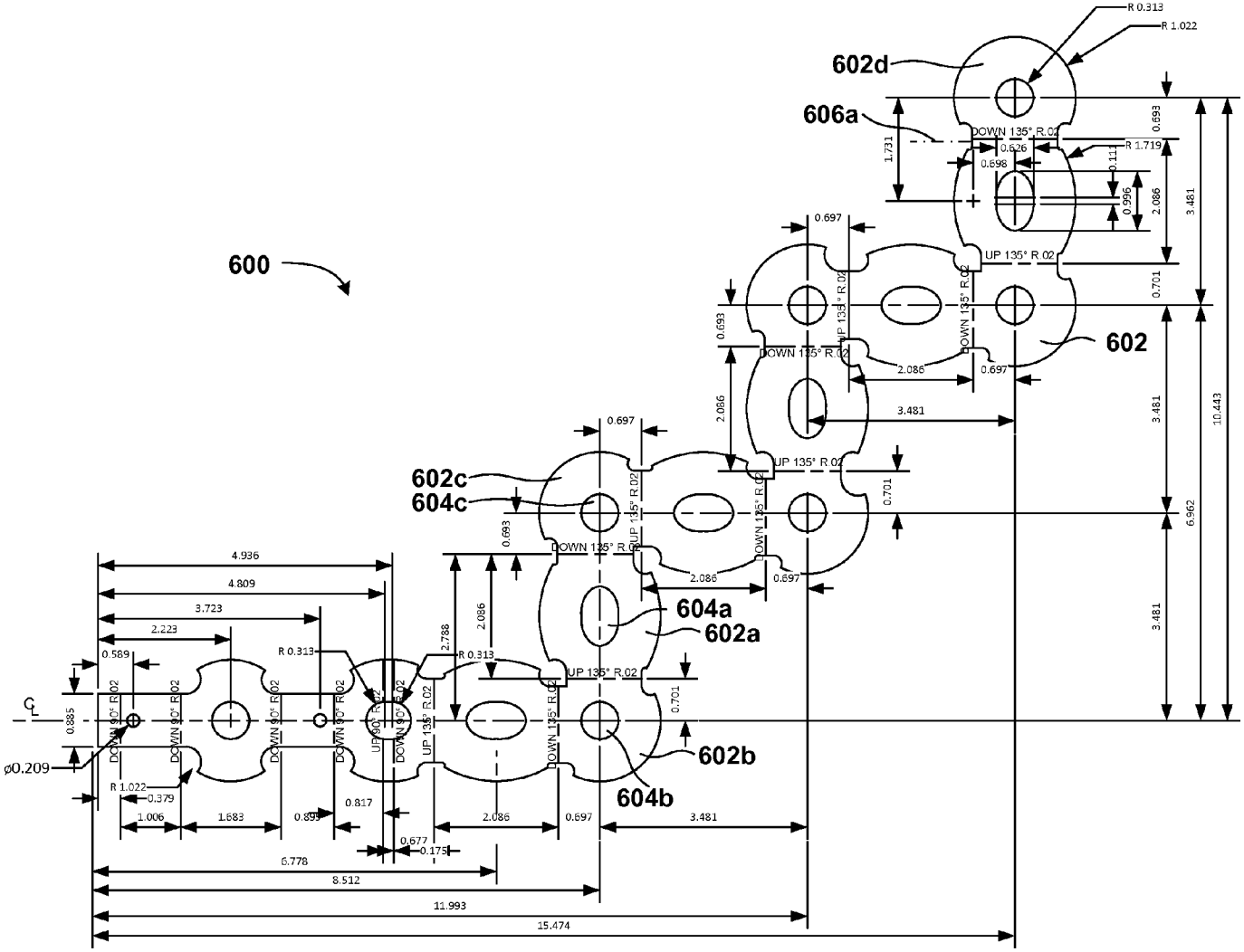
FIG. 6 is a line drawing illustrating a top view of a baffle insert blank that can be used to form a baffle insert assembly, according to one illustrative embodiment of the concepts and technologies described herein.

Turning now to FIG. 6, additional aspects of the concepts and technologies described herein for firearm suppressors 400 will be described in detail. In particular, FIG. 6 is a line drawing illustrating a view of a baffle insert blank 600 that can be used to form a baffle insert assembly such as the baffle insert assembly 300 illustrated and described herein with reference to FIGS. 3-5B. It should be understood that the configuration, dimensions, and layout of the baffle insert blank 600 are illustrative and should not be construed as being limiting in any way.

As is visible in FIG. 6, the baffle insert blank 600 can include a number of baffle portions 602 that, when arranged according to the concepts and technologies described herein, provide baffles such as the baffles 302 illustrated and described above with reference to FIGS. 3-5B. In the illustrated embodiment, the baffle insert blank 600 can include baffle portions 602*a*, 602*b*, and 602*c*, among other baffle portions 602. The baffle portions 602*a*, 602*b*, and 602*c* can be arranged such that the baffle portions 602*a*, 602*b*, and 602*c* function as three baffles such as the baffles 302*a*, 302*b*, 302*c* illustrated and described above with reference to FIG. 3, though this is not necessarily the case.

The baffle portions 602*a*, 602*b*, and 602*c* can include apertures 604*a*, 604*b*, and 604*c*. Thus, when the baffle portions 602*a*, 602*b*, and 602*c* are arranged such that the baffle portions 602*a*, 602*b*, 602*c* function as three baffles such as the baffles 302*a*, 302*b*, 302*c*, the apertures 604*a*, 604*b*, 604*c* can function as the apertures 304*a*, 304*b*, 304*c* illustrated and described above with reference to FIG. 3, though this is not necessarily the case. It can be appreciated, with reference to FIG. 6, that the size and configuration of the baffle portions 602*b*, 602*c* may differ substantially relative to the size and configuration of the baffle portion 602*a*. Similarly, the diameter, shape, and configuration of the apertures 604*b*, 604*c* may differ substantially relative to the diameter, shape, and configuration of the aperture 604*a*.

With reference to FIG. 6, it can be appreciated that the baffle insert assembly 300 can be formed by bending the baffle insert blank 600 via various bend operations. Thus, for example, the baffle portion 602*d* can be bend along a bend line 606*a* to obtain a first (or last) baffle 302, and subsequent bend operations can be performed to obtain a baffle insert assembly 300 that includes a number of baffles 302 as shown in the various embodiment of the baffle insert assembly 300 illustrated and described above. It can be appreciated with reference to FIG. 6 that a baffle insert assembly 300 formed from the baffle insert blank 600 will have fourteen baffles 302. Because fewer than fourteen baffles 302, fourteen baffles 302, or more than fourteen baffles 302 are possible by modifying the baffle insert blank 600, it should be understood that this example is illustrative and therefore should not be construed as being limiting in any way.

It can be appreciated with reference to FIG. 6 that the cost of manufacturing a baffle insert assembly 300 by bending a baffle insert blank such as the baffle insert blank 600 an be extremely economical. In particular, the baffle insert assembly 300 can be formed from a substantially continuous and/or unitary piece of material, which can simplify and reduce costs associated with manufacturing. In fact, the baffle insert assemblies 300 can be formed and later processed using a bending machine such as a press brake, or the like. Thus, the baffle insert blanks 600 can be manufactured by a first manufacturer and later processed to obtain baffle insert assemblies 300. This approach can significantly reduce shipping and manufacturing costs associated with manufacturing a firearm suppressor 400.

Furthermore, because some embodiments of the concepts and technologies described herein can use a single piece of sheet metal or other material to form the baffle insert blank 600, costs of materials and manufacturing associated with forming the baffle insert assembly, relative to other forming, machining, or other processes (e.g., electrical discharge machining ("EDM"), forging, casting, or the like) can be reduced. As noted above, multiple baffle insert blanks 600 can be used, in some embodiments, to form multiple baffle insert assemblies 300, with different, similar, or even identical advantages, in some embodiments.

Similarly, in some embodiments transporting the baffle insert blanks 600 in bulk may be easy relative to shipping baffle insert assemblies 300 in bulk because the baffle insert blanks 600 may lay flat in a container and/or can be palletized, while baffle insert assemblies 300 may need to be padded and/or individually packaged to avoid damage, thereby complicating transportation, balance, and/or packaging issues. Thus, using the baffle insert blank 600 to from the baffle insert assemblies 300 can reduce costs associated with manufacturing, shipping, and/or storing the baffle insert assemblies 300. Because the use of the baffle insert blank 600 as disclosed herein can reduce costs of the firearm suppressor 400 in additional and/or alternative ways, it should be understood that these examples are illustrative and therefore should not be construed as being limiting in any way.

Turning now to FIGS. 7A-7E, additional aspects of the concepts and technologies described herein for firearm suppressors 400 will be described in detail. In particular, FIGS. 7A-7E are line drawings illustrating various views of a baffle insert assembly 300 for a firearm suppressor 400, according to yet another illustrative embodiment of the concepts and technologies described herein. In particular, the embodiment of the baffle insert assembly 300 shown in FIGS. 7A-7E can be obtained by bending the example baffle insert blank 600 shown in FIG. 6. Because the example baffle insert blank 600 shown in FIG. 6 is merely illustrative of one contemplated embodiment of the baffle insert blank 600, it should be understood that the example baffle insert assembly 300 shown in FIGS. 7A-7E is illustrative and therefore should not be construed as being limiting in any way.

As shown with collective reference to FIGS. 7A-7E, the baffle insert assembly 300 can include baffles 302 formed from the baffle portions 602 illustrated and described in FIG. 6. As noted above with reference to FIG. 6, the dimensions and angles shown in FIGS. 7A-7E are illustrative of one contemplated embodiment and should not be construed as being limiting in any way. In particular, diameters of the apertures 700 of the baffle insert assembly 300, the diameter and/or height 702 of the baffle insert assembly 300, the overall length 704 of the baffle insert assembly 300, the distances 706 between the baffles 302 of the baffle insert assembly 300, and/or the offset angles 708 between the baffles 302 of the baffle insert assembly 300 can be varied for various purposes.

In particular, these and other dimensions of the baffle insert blank 600 and/or the baffle insert assembly 300 can be varied for various calibers, performance characteristics, weight and/or balance of the firearm suppressor 400 and/or a firearm equipped with the firearm suppressor 400, combinations thereof, or the like. As such, it should be understood that the embodiment shown in FIGS. 7A-7E is merely illustrative of one contemplated embodiment of the baffle insert assembly 300 and therefore should not be construed as being limiting in any way.

Figure 7C:
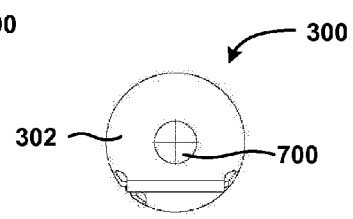
FIGS. 7A-7E are line drawings illustrating various views of a baffle insert assembly obtained by bending the baffle insert blank shown in FIG. 6, according to one illustrative embodiment of the concepts and technologies described herein.
Figure 7D:
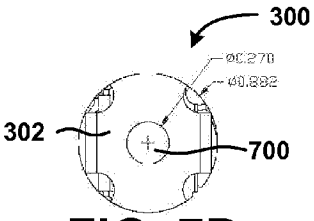
Figure 7A:
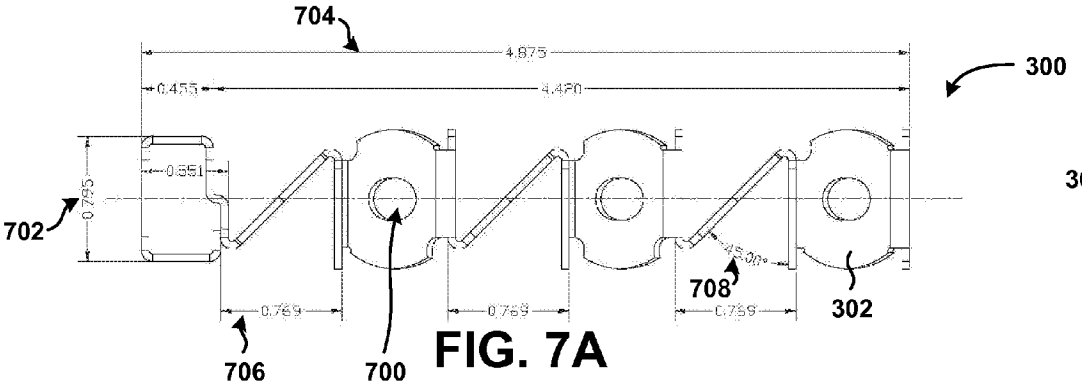
Figure 7B:
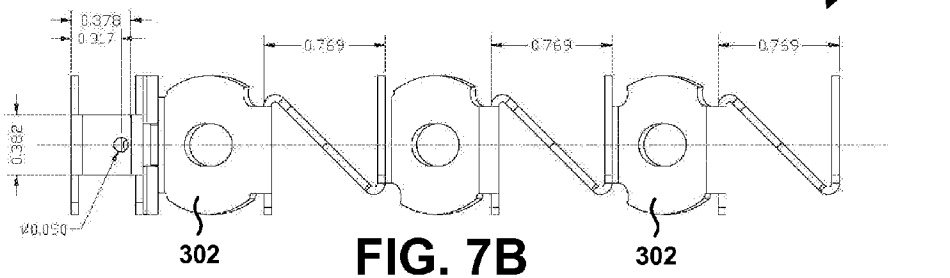
Figure 7E:
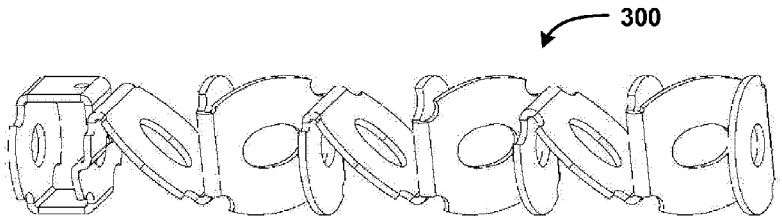

As can be appreciated with reference to FIGS. 7C-7D, the apertures 700 of the baffles 302 and/or the apertures 700 can align with one another. Thus, a bullet or other projectile, cleaning tool, bore light, sighting device, or the like, can pass through the apertures 700 of the baffle insert assembly 300 and/or a firearm suppressor 400 equipped with the baffle insert assembly 300. It should be understood that this example is illustrative and therefore should not be construed as being limiting in any way.

As is generally understood by one knowledgeable about firearm suppressor technologies, the arrangement, configuration, and/or size of the baffles 302 and their neighboring structures can affect the expansion and/or temperature of gasses escaping from a firearm during firing. Thus, the baffles 302 of the baffle insert assembly 300 can be configured and/or arranged based upon various performance, design, and/or other considerations to control the expansion of gas, the temperature of the gas, and/or otherwise to control the explosion associated with the firing of a firearm.

For example, if a firearm suppressor 400 is being used primarily to control visible muzzle blast associated with a firearm, the baffles 302 may be configured in a first arrangement, while if the firearm suppressor 400 is being used primarily to control audible muzzle blast associated with a firearm, the baffles 302 may be configured in a second arrangement. Also, although not visible in the FIGURES, the baffles 302 and/or the baffle insert assembly 300 can be reinforced with various structures to increase the strength of the baffles 302 and/or the baffle insert assembly 300. Because the numerous modifications, configurations, and/or arrangements of the baffles 302 are too numerous to illustrate, it should be understood that the illustrated examples are merely illustrative of some contemplated embodiments and therefore should not be construed as being limiting in any way.

According to various embodiments of the concepts and technologies described herein, the use of sheet metal to form the baffle insert blank 600 also can result in a lightweight baffle insert assembly 300, relative to other baffle designs such as stacked cone designs, "K" style baffles, "M" style baffles, or the like. Furthermore, because some embodiments of the baffle insert assembly 300 can be formed as a single component, cleaning the firearm suppressor 400 can be simplified relative to cleaning a stacked cone or other similar firearm suppressor device. In particular, the baffle insert assembly 300 can be removed from the firearm suppressor housing 100 as a single piece. This single piece can be cleaned with various solvents and/or immersed in a solvent bath, for example, instead of cleaning each cone or other component as would be required for a stacked cone design firearm suppressor. Because some embodiments of the firearm suppressor 400 can include two or more baffle insert assemblies 300, which can be stacked or connected together, if desired, it should be understood that some embodiments of the baffle insert assembly 300 can include two or more components with different, similar, or even identical advantages.

Furthermore, because the expanding gases produced during firearm discharges can produce or include particles such as gunpowder residue, lubricant residue, bullet residue, barrel material residue, or the like, the baffles inserted into other firearm suppressors sometimes are difficult to remove from a housing. The concepts and technologies described herein can provide embodiments of the firearm suppressor that allow gripping of the baffle insert assembly 300 and removal of the baffle insert assembly from the firearm suppressor housing 100 to enable easy cleaning of the firearm suppressor 400. It should be understood that this example is illustrative and therefore should not be construed as being limiting in any way.

Because the baffle insert assembly 300 can be formed from lightweight materials such as titanium, or the like, the concepts and technologies described herein also can provide embodiments of the baffle insert assembly 300 that are lightweight relative to other suppressor designs. Because low weight can be beneficial for military, police, home defense, and/or other applications, as well as more comfortable for recreational firearm shooting, embodiments of the concepts and technologies described herein can provide improvements in terms of weight reduction relative to other baffle designs. It should be understood that this example is illustrative and therefore should not be construed as being limiting in any way.

According to various embodiments of the concepts and technologies described herein, the sidewalls 402 of the firearm suppressor housing 100 can be used to align and reinforce the structure of the baffle insert assembly 300. Because the sidewalls 402 of the firearm suppressor housing 100 can align and reinforce the structure of the baffle insert assembly 300, the firearm suppressor 400 can essentially have a honeycomb type design that can be extremely rigid and strong. In particular the baffles 302 that are perpendicular to the path of the projectile can be perpendicular to the sidewalls 402 of the firearm suppressor housing 100, and therefore the sidewalls 402 of the firearm suppressor housing 100 and the baffles 302 can reinforce one another. This arrangement also can improve the durability of the firearm suppressor 400, which may be valuable in various applications (e.g., military, police, sporting, etc.). It should be understood that this example is illustrative and therefore should not be construed as being limiting in any way.

According to various embodiments of the concepts and technologies described herein, surface area of the baffles 302 of the baffle insert assembly 300 can be maximized (as volume of the baffle insert assembly 300) can be reduced. This arrangement can provide enhanced suppression associated with the firearm suppressor 400 as increased surface area is known to contribute to the ability of a firearm suppressor 400 to shear, divert, diffuse, and/or reduce the pressure and noise of a muzzle blast. It should be understood that this example is illustrative and therefore should not be construed as being limiting in any way.

According to various embodiments of the concepts and technologies described herein, the design of the baffle insert assembly 300 can be used to provide a modular firearm suppressor 400. In particular, a single firearm suppressor housing 100 can be configured to house multiple baffle insert assemblies 300. Because of the taxation of firearm suppressors, as well as the legal and regulatory framework that must be navigated to legally obtain a firearm suppressor, the modularity of the firearm suppressor 400 can provide additional benefits by reducing the costs associated with obtaining a firearm suppressor. In particular, a user can obtain a single firearm suppressor housing 100 and multiple baffle insert assemblies 300 for far less material cost, taxes, and fees relative to obtaining multiple firearm suppressors of a different design. It should be understood that this example is illustrative and therefore should not be construed as being limiting in any way.

Figure 8:
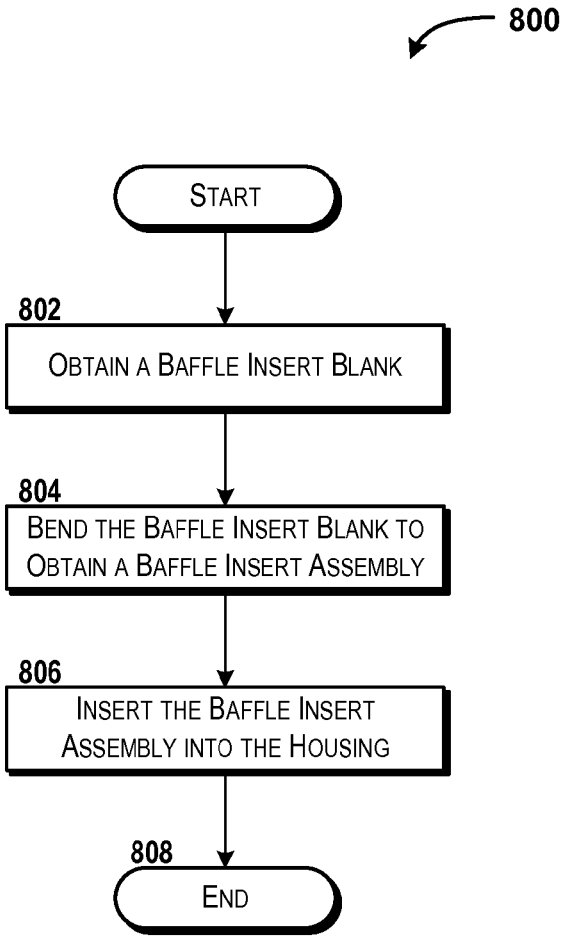
FIG. 8 is a flow diagram schematically illustrating a method for forming a firearm suppressor using a baffle insert blank and a housing, according to one embodiment of the concepts and technologies described herein.

Turning now to FIG. 8, aspects of a method 800 for forming a firearm suppressor 400 will be described in detail, according to an illustrative embodiment. It should be understood that the operations of the method 800 disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the appended claims. It also should be understood that the illustrated method 800 can be ended at any time and need not be performed in its entirety.

For purposes of illustrating and describing the concepts of the present disclosure, the method 800 is described as being performed by a forming device or series of forming devices (e.g., an assembly line) via execution of one or more software modules such as, for example, a suppressor forming application. In one contemplated embodiment of the concepts and technologies described herein, the operations of the method 800 described herein can be performed by a press brake or other bending machine. It should be understood that additional and/or alternative devices can provide the functionality described herein via execution of one or more modules, applications, and/or other software including, but not limited to, the suppressor forming application. Thus, the illustrated embodiments are illustrative, and should not be viewed as being limiting in any way.

The method 800 begins at operation 802. In operation 802, the forming device obtains a baffle insert blank 600 and a firearm suppressor housing such as the firearm suppressor housing 100. The baffle insert blank 600 can include a piece of sheet metal that can be configured to form a baffle insert assembly 300 or other insert element that, when inserted into the firearm suppressor housing 100, functions as a baffle or baffle set for a firearm suppressor 400 as explained herein-above. The firearm suppressor housing can include the firearm suppressor housing 100 described herein, though this is not necessarily the case. It should be appreciated that the firearm suppressor housing 100 and the baffle insert blank 600 can be obtained from more than one source, in some embodiments.

While not shown in FIG. 8, it should be understood that in some embodiments, a manufacturer or other entity performing the method 800 may obtain a sheet of material prior to performing operation 802. Thus, the method 800 can include an operation for obtaining the material and/or operations for processing the material to obtain the baffle insert blank 600 obtained in operation 802. For example, a sheet of material can be obtained and machined, stamped, or otherwise processed to obtain the baffle insert blank 600 shown in FIG. 6. It should be understood that this example is illustrative and therefore should not be construed as being limiting in any way.

From operation 802, the method 800 proceeds to operation 804. In operation 804, the forming device can bend the baffle insert blank 600 to obtain a baffle insert assembly 300 as described above. According to various embodiments, the baffle insert blank 600 can be bent multiple times by the forming device to provide a number of baffles or other surfaces that are arranged in a manner that is configured to provide silencing, muffling, or other suppression capabilities for a firearm suppressor such as the firearm suppressor 400. It should be understood that this example is illustrative and therefore should not be construed as being limiting in any way.

From operation 804, the method 800 proceeds to operation 806. In operation 806, the forming device can insert the baffle insert assembly 300 into the firearm suppressor housing 100 obtained in operation 802. Thus, the baffle insert assembly 300 can be inserted, for example, into the firearm suppressor housing 100. It should be understood that this example is illustrative and therefore should not be construed as being limiting in any way.

From operation 806, the method 800 proceeds to operation 808. The method 800 can end at operation 808.

Based on the foregoing, it should be appreciated that embodiments of a firearm suppressor have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A baffle insert assembly configured for insertion into a firearm suppressor housing, the firearm suppressor housing comprising an inner cavity and an attachment mechanism that is configured to attach the firearm suppressor housing at a location proximate to a barrel of a firearm, the baffle insert assembly comprising:

a plurality of baffles formed by bending a baffle insert blank formed from a single sheet of metal, wherein the plurality of baffles comprises a first baffle that is angularly offset from a second baffle by an angle, wherein the first baffle comprises a first planar surface, and wherein the second baffle comprises a second planar surface.

2. The baffle insert assembly of claim 1, wherein the firearm suppressor housing further comprises sidewalls, and wherein the baffle insert assembly is configured to contact the sidewalls to align the plurality of baffles within the firearm suppressor housing.

3. The baffle insert assembly of claim 1, wherein the plurality of baffles further comprises a third baffle angularly offset from the first baffle by a further angle.

4. The baffle insert assembly of claim 3, wherein the angle is equivalent to the further angle.

5. The baffle insert assembly of claim 3, wherein the angle is different from the further angle.

6. A firearm suppressor comprising:

a firearm suppressor housing comprising an outer surface, an inner cavity that accommodates a baffle insert assembly, and an attachment mechanism that attaches the firearm suppressor housing to a barrel of a firearm; and the baffle insert assembly, wherein the baffle insert assembly comprises a plurality of baffles that comprises a first baffle that is angularly offset from a second baffle by an angle, wherein the first baffle comprises a first planar surface, wherein the second baffle comprises a second planar surface, and wherein the baffle insert assembly is formed by bending a baffle insert blank formed from a single sheet of metal.

7. The firearm suppressor of claim 6, wherein the plurality of baffles comprises ten or more baffles.

8. The firearm suppressor of claim 6, wherein the first baffle is angularly offset from a third baffle by a further angle.

9. The firearm suppressor of claim 8, wherein the angle is equivalent to the further angle.

10. The firearm suppressor of claim 8, wherein the angle is different from the further angle.

11. The firearm suppressor of claim 6, wherein the firearm suppressor housing comprises sidewalls, and wherein the baffle insert assembly is configured to contact the sidewalls to align the plurality of baffles within the firearm suppressor housing.

12. The firearm suppressor of claim 6, wherein the baffle insert assembly is formed from a material selected from a group of materials consisting of titanium, aluminum, and steel.

13. A method comprising:

obtaining, at a forming device, a baffle insert blank formed from a single sheet of metal; and bending, at the forming device, the baffle insert blank to obtain a baffle insert assembly that comprises a plurality of baffles comprising a first baffle that is angularly offset from a second baffle by an angle, wherein the first baffle comprises a first planar surface, wherein the second baffle comprises a second planar surface, wherein the baffle insert assembly can be located within a firearm suppressor housing, and wherein the firearm suppressor housing comprises an outer surface, an inner cavity that accommodates the baffle insert assembly, and an attachment mechanism that attaches to a location proximate to a barrel of a firearm.

14. The method of claim 13, wherein the plurality of baffles comprises ten or more baffles.

15. The method of claim 13, wherein the first baffle is angularly offset from a third baffle by a further angle.

16. The method of claim 15, wherein the angle is equivalent to the further angle.

17. The method of claim 15, wherein the angle is different from the further angle.

18. The method of claim 13, wherein the firearm suppressor housing comprises sidewalls, and wherein the baffle insert assembly is configured to contact the sidewalls to align the plurality of baffles within the firearm suppressor housing.

19. The method of claim 13, wherein each of the plurality of baffles comprises an aperture through which a bullet fired from the firearm passes.

20. The method of claim 19, wherein aligning the plurality of baffles comprises aligning apertures of the plurality of baffles.

* * * * *